US005194896A

United States Patent [19]

Buch et al.

[11] Patent Number: 5,194,896

[45] Date of Patent: Mar. 16, 1993

[54] MAGNETIC BRAKE FOR PIVOTAL DEVICE

[75] Inventors: Donald C. Buch, Penfield; John P. Marcelletti, Hilton, both of N.Y.

[73] Assignee: Eastman Kodak Company, N.Y.

[21] Appl. No.: 827,298

[22] Filed: Jan. 29, 1992

[51] Int. Cl.[5] ..... G03G 5/00

[52] U.S. Cl. ..... 355/212; 188/158; 355/202

[58] Field of Search ..... 188/267, 158, 161, 159; 355/200, 202, 211, 212, 210

[56] References Cited

U.S. PATENT DOCUMENTS

| | | | |
|---|---|---|---|
| 2,956,718 | 10/1960 | Beveridge | 226/50 |
| 3,974,952 | 8/1976 | Swanke et al. | 355/212 X |
| 4,013,358 | 3/1977 | Kawai | 355/212 |
| 4,110,670 | 8/1978 | Araki et al. | 188/158 X |
| 4,671,645 | 6/1987 | Saito et al. | 355/211 |
| 4,821,066 | 4/1989 | Foote, Jr. et al. | 355/212 X |
| 4,884,105 | 11/1989 | Joseph et al. | 355/212 |

*Primary Examiner*—A. T. Grimley
*Assistant Examiner*—William J. Royer
*Attorney, Agent, or Firm*—D. Peter Hochberg; Mark Kusner

[57] ABSTRACT

A brake for a sprocket-optical encoder assembly associated with an electrophotographic copier consists of a metal disc positioned in a magnetic field, mounted on a common shaft with the sprocket driving an optical encoder. The teeth of the sprocket are engaged in perforations in the photoconductor film belt of the copier, and the sprocket and the shaft, together with the disc and encoder are, therefore, driven by movement of the film. As the disc is caused to rotate in the magnetic field, eddy currents are generated therein which resist the rotation. Such resistance acts as a brake on the sprocket, causing the trailing edge of its teeth to maintain contact with the trailing edge of the perforations, thereby avoiding back and forth movement of the teeth within the perforations and consequential destructive impacts with the edges thereof.

9 Claims, 2 Drawing Sheets

MAGNETIC BRAKE FOR PIVOTAL DEVICE

TECHNICAL FIELD

This invention relates to electrophotography and to electrophotographic copying processes, including machines in which such processes are carried out. More particularly, this invention relates to optical encoders used in such machines, and to ways in which contact of the encoder's sprocket teeth with a specific edge of the perforations located in the photoconductor films used in conjunction with such machines can be maintained. Specifically, this invention relates to a magnetic brake associated with the encoder's sprocket shaft which is designed to exert a drag on the shaft of a magnitude sufficient to maintain the desired contact.

BACKGROUND ART

Electrophotographic-type processes involve devices one of whose components includes a layer of photoconductive insulating material fixed to a conductive backing to form a film structure termed a "photoconductor". Initially, the photoconductor is uniformly electrostatically charged over its entire surface, following which it is exposed to a light pattern corresponding to an image to be reproduced. The charge on those surface areas impacted by the light of the image is thereby relatively dissipated, leaving only areas not so impacted in a charged condition. The charge remaining on the surface, therefore, conforms to the configuration of the light pattern reflected from the image to be reproduced.

This latent electrostatic image on the photoconductor can be subsequently developed by exposing it to finely divided, electrostatically attractable, particulate material. The material is drawn to such surface areas in amounts proportional to the magnitude of the charge in the electrostatically affected areas, thereby forming a temporary image of the material being copied.

The particulate material used to create the temporary image on the photoconductor, referred to in the industry as "toner", typically consists of a pigmented, thermoplastic resinous material which can subsequently be transferred to a supporting substrate on which the image of the document being copied is to be permanently fixed. Such a transfer can be accomplished, for example, with a corona discharge device that produces a charge on the substrate, opposite in nature to the charge of the toner forming the temporary image. Subsequent transfer of the temporary toner image to the substrate by electrostatic attraction occurs when the substrate and the photoconductor with the temporary image thereon are brought into proximity with each other. The transferred image can thereafter be fixed to the substrate by fusing the toner thereto, using any of the several known methods.

The photoconductor employed by the process commonly takes the form of an endless "belt" propelled by drive means which moves the belt through the various stages of the process. In the course of such progression, it is of importance that the rate of travel of the belt, and therefore, the time within which the various processing steps are performed be carefully controlled, otherwise improperly toned, and/or distorted images can result.

In order to make such control possible in electrophotographic machines of the type described, resort is frequently had to the use of an optical encoder device. The encoder comprises a disc provided with radial slots therein, having a light source positioned on one side thereof, and a light detector on the other. The perforated disc rotates on a shaft on which a sprocket is also mounted, the teeth of the sprocket engaging and being driven by perforations provided in the photoconductor. The frequency of detected light impulses as the perforated disc rotates, therefore, provides an indication of the characteristics of the belt travel. This information in the form of electrical impulses is transferred to the machine's logic control center, which then adjusts the operating parameters of the machine accordingly, in order to meet desired values.

While machine control is effectively accomplished with the encoder system described, the system is not, however, without problems. In this regard, maintaining contact of the sprocket teeth with a particular edge of the perforations in the photoconductor, for example the trailing edge, is a difficult task due to fluctuations in the velocity, acceleration, etc. of the photoconductor film. These variations cause the position of the teeth of the sprocket, relative to the perforations, to be quite variable. The result is that at a particular point in time, a given tooth is in contact with the trailing edge of a perforation, while at another, it is forced against the perforations leading edge. This constant movement back and forth within the perforations produces impacts which over time result in destructive damage to the film perforations, as well as in inaccuracies in the detection process, creating consequential problems relating to machine control, and causing the production of defective copies.

While these difficulties could to a certain degree be avoided through the provision of a frictional drag device operating on the sprocket-optical encoder assembly which would tend to maintain the trailing edge of the sprocket teeth against the trailing edge of the perforations, unfortunately, frictional devices tend to undergo gradual wear, causing increasingly erratic braking behavior. Furthermore, such brakes often exhibit variable coefficients of friction in changing environments, and are subject to substantial variability in their braking characteristics, particularly at the low force values encountered in the case of the optical encoder devices contemplated by the invention.

SUMMARY OF THE INVENTION

In view of the preceding, therefore, it is a first aspect of this invention to provide better control of the operating parameters of machines for carrying out electrophotographic processes.

A second aspect of this invention is to provide means for avoiding damage to the perforations contained in photoconductor belts employed with electrophotographic devices.

Another aspect of this invention is to provide a way in which to maintain the teeth of a sprocket associated with an optical encoder for an electrophotographic device in contact with particular faces of the perforations located in the device's photoconductor.

An additional aspect of this invention is to provide a braking device able to exert a drag force on the sprocket shaft associated with an optical encoder used in connection with an electrophotographic device.

A further aspect of this invention is to provide a braking device for the sprocket-optical encoder assembly of an electrophotographic device that does not depend upon friction for its braking effect.

Yet another aspect of this invention is to provide a braking device for a sprocket-optical encoder assembly useful in electrophotographic devices that relies on the generation of eddy currents produced by a magnetic force field for its braking characteristics.

A still additional aspect of this device is to provide a device in which the force resisting movement of a metal disc through a magnetic field resulting from the presence of magnetically generated eddy currents in the disc is used to brake the rotation of the shaft on which the disc is mounted.

The foregoing and additional aspects of this invention are provided in a preferred embodiment of the invention by electrically conductive means such as a metallic disc mounted on shaft means such as the rotating shaft of an optical encoder associated with an electrophotographic device, a pivotable device such as a sprocket, the sprocket driving the encoder also being mounted on the shaft. The disc is rotated in a magnetic field by rotation of the sprocket which is driven by means of the engagement of its teeth with perforations located in the moving carrier means such as photoconductor film associated with the device. Movement of the disc through the magnetic field induces eddy currents in the disc which oppose the rotational motion of the disc in the field, thus producing a braking affect on the shaft. The oppositional force acts as a drag on the sprocket, causing the trailing edges of the teeth to maintain contact with the trailing edges of the perforations.

BRIEF DESCRIPTION OF THE DRAWINGS

The invention will be better understood when reference is had to the following drawings, in which like-numbers refer to like-parts and in which.

BEST MODE FOR CARRYING OUT THE INVENTION

Figure 1:
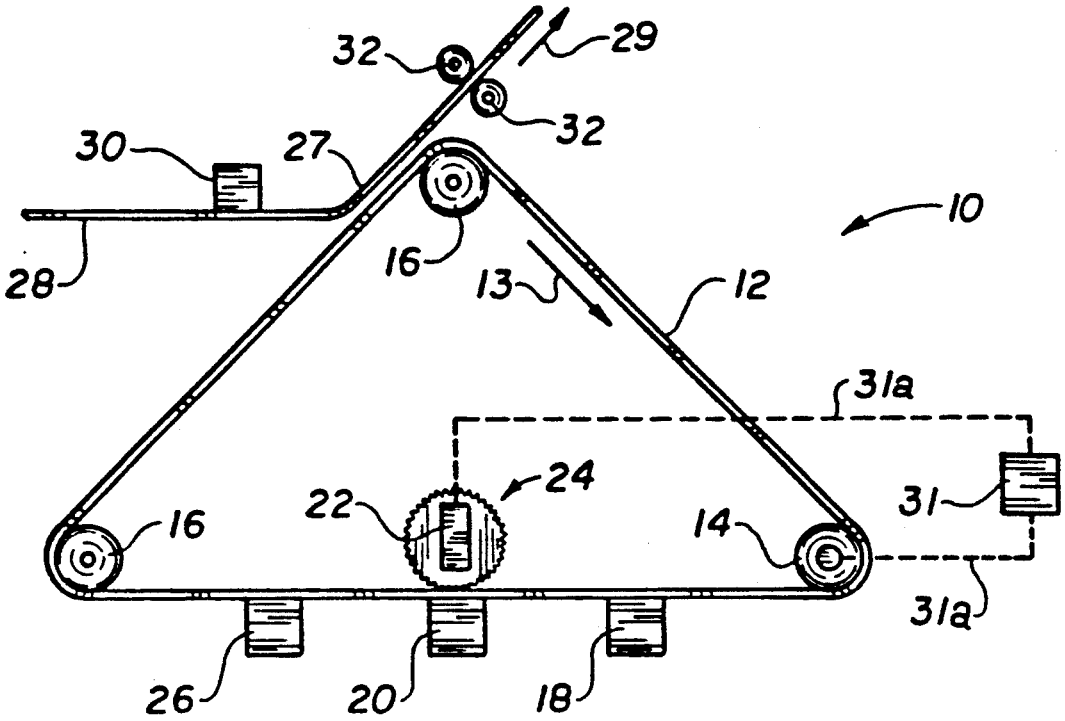
FIG. 1 is a schematic drawing of an electrophotographic copying device with an optical encoder magnetic brake of the invention.

FIG. 1 is a schematic drawing of an electrophotographic copying device, generally 10, provided with an optical encoder magnetic brake of the invention.

As shown, an endless photoconductor film belt 12, driven by drive means, for example a drive roller 14, moves about the drive roller and guide rollers 16. At the beginning of a copying sequence, the photoconductor receives a charge over its entire surface as a consequence of the action, for instance, of a corona charger 18. The electrostatically charged photoconductor then moves past a "writing device" which may be a light image, or other source of information capable of dissipating the charge on the photoconductor in a pattern corresponding to the pattern of the image or nature of the information to be reproduced.

An optical encoder 22 is located relatively close to the writing device 20, the encoder including a sprocket-brake assembly 24 connected thereto. The teeth of the sprocket, better seen in connection with FIG. 2, engage and are driven by a series of perforations in the photoconductor belt, also better seen in the latter Figure. The sprocket is connected by a common shaft both to the optical encoder 22 and the braking device more fully illustrated in FIG. 2. The rotation of the sprocket reflects the movement of the photoconductor, imparting information regarding such movement to the encoder and is subject to the retarding influence of the magnetic brake.

The photoconductor thereafter proceeds to a toner station 26 where toner is attracted to the latent image on the photoconductor in proportion to the charge on the surface thereof, thus yielding a temporary image. Subsequently, the photoconductor proceeds to an area of proximity 27 between photoconductor belt 12 and an image substrate 28, for example, paper on which the image or other information is to be fixed.

The image substrate 28 is guided past a transfer charger 30 which causes a charge to be deposited on the surface of the substrate, and thereafter enters the area of proximity 27 between the substrate and the photoconductor belt 12. At the point of proximity, the toner is attracted to the substrate 28, causing an informational image to be formed thereon, the image carrying substrate 28 then proceeding, for instance, to fuser rollers 32 at which point the image is fixed to the substrate as a result of the toner being fused thereto. The substrate 28 and the photoconductor belt 12 move in the direction shown by the associated arrows 29 and 13, respectively.

Electrical signals are transmitted, for example, from the optical encoder to a machine logic control center 31 by circuitry 31*a*, and control signals generated in the logic control center, for instance, are also conveyed by means of circuitry 31*a*, for instance, to drive roller 14, which in turn acts upon the photoconductor belt 12 in accordance with the directional signals received. Control thus exercised can, for example, cause the transport mechanism, including drive roller 14, to go faster or slower, or to alter the operation of the machine in other necessary ways, such as the synchronization of other process elements to the position of the transport mechanism at any given time. Such control and synchronization may be carried out in order to produce more perfect copies and to otherwise eliminate process defects.

Figure 2:
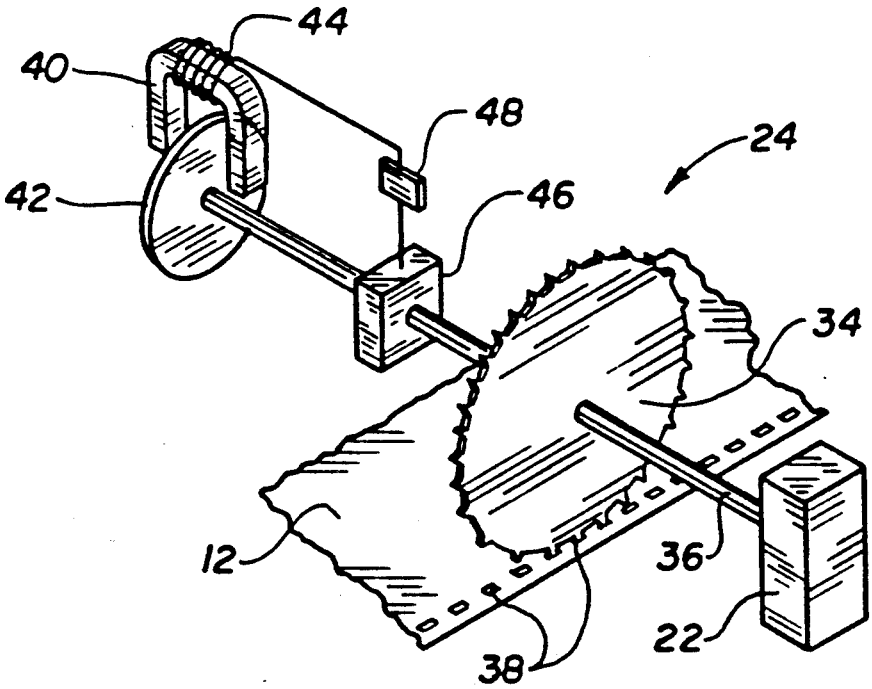
FIG. 2 is a schematic drawing of a sprocket-optical encoder assembly which includes a magnetic brake of the invention.

FIG. 2 is a schematic drawing of a sprocket-optical encoder assembly, generally 24, which includes a magnetic brake of the invention.

In the Figure, the optical encoder 22 is connected by means of shaft 36 to a toothed encoder sprocket 34. The teeth of the sprocket engage perforations 38 in the photoconductor belt 12, the sprocket being driven thereby, and in turn, imparting information regarding operating characteristics of the photoconductor to the optical encoder 22.

Shaft 36 may also have mounted thereon a transducer 46 which can, for example, measure the torsion acting upon shaft 36 caused by the retarding effect of brake disc 42. The brake disc passes through a magnetic field generated by brake magnet 40, the rotation of the brake disc causing the generation of eddy currents therein which cause the disc to resist being rotated through the magnet, and thus to act as a brake on shaft 36.

Magnet 40 may be a permanent magnet, or more desirably be provided with electrical windings 44 connected to a power source through circuitry 48. Electromagnets form a preferred embodiment of the invention, since they can be adjusted to provide greater or lesser flux density, depending upon the braking action required. The provision of transducer 46 is advantageous, since its output can be designed to affect the circuity 48 in such a way as to furnish control feedback through the coils 44. This allows operation of the magnet 40 to be influenced by the amount of braking force generated thereby, permitting automatic compensation for variations in the amount of braking action required.

While the physical dimensions of the brake wil depend upon the other dimensions of the electrophotographic device, including the amount of braking energy that must be generated, commonly the disc 42 will be designed to minimize inertia inherent therein and will have, for example, a diameter of about 2 inches and a width of about 0.06 inch.

The gap between the poles of the magnet and the disc will reflect the magnetic flux density required to act on the disc in order to produce the desired braking energy; often however, and in the case of discs having dimensions similar to those indicated, the gap will typically be around 0.01 inch.

Figure 3:
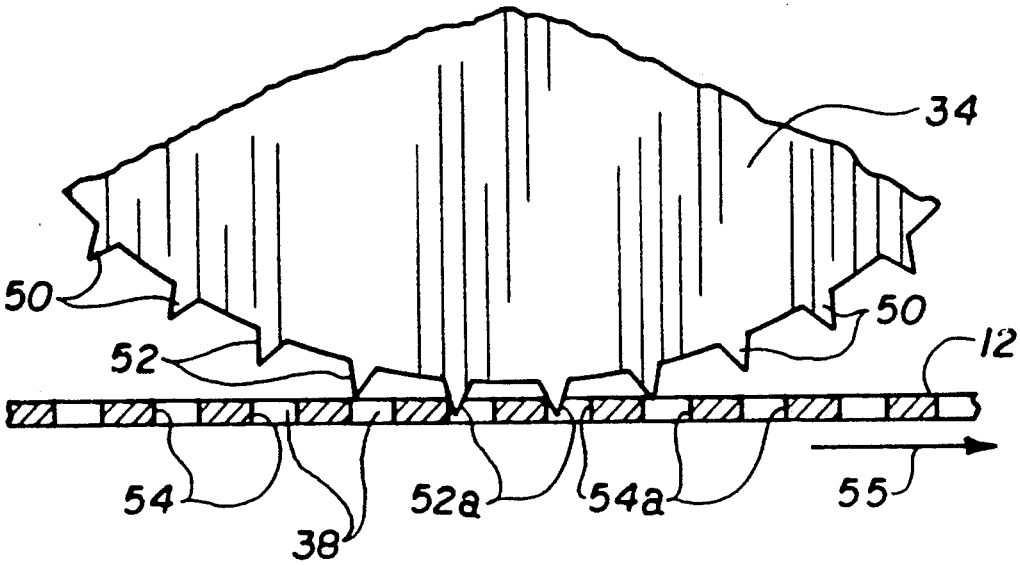
FIG. 3 is a partial view of the sprocket of an assembly according to FIG. 2 whose teeth are engaged in the perforations of a photoconductor film.

FIG. 3 is a partial view of the sprocket of an assembly according to FIG. 2 whose teeth are engaged in the perforations of a photoconductor belt. The dimensions of the perforations 38 in the photoconductor belt 12 may also be widely varied, and will depend upon the design of the sprocket 34. Within such considerations, however, perforations spaced at intervals of about 0.2 inch and having a similar length and width, are often employed.

As shown, the teeth 50 of an encoder sprocket 34 are engaged in perforations 38 of a photoconductor belt 12 which is moving in a direction 55. It will be observed that the trailing edge 52 of the teeth 50 normally engages the trailing edge of the perforations 54. While this is the normal position required for the sprocket 34 to be driven by the photoconductor belt 12, it will be appreciated that the movement of the photoconductor for one reason or another is frequently erratic as the result of velocity fluctuations. When the photoconductor belt slows, for example, the inertia of the sprocket 34 causes the teeth 50 to move faster than the perforations 38, resulting in the leading edge 52*a* of the teeth 50 coming into engagement with the leading edge 54*a* of the perforations 38. This change in relative position can often occur very suddenly, resulting in a sharp impact on the leading edge of the perforations. When the sprocket 34 thereafter increases its velocity, the reverse action occur, the trailing edge 52 of the teeth 50 striking the trailing edge 54 of the perforations 38. Each of these impacts results in stresses on, and consequential damage to the perforations, ultimately detrimentally affecting the shape and uniformity of the perforations, and producing erratic motion in the optical encoder. The extent of damage to their surfaces often differs from perforation-to-perforation resulting in consequential irregularity in the operation of the optical encoder, and therefore, the quality of the images produced by the process tends to be undesirably variable.

While other types of sprockets may be employed, depending upon considerations including those previously referred to, in the case of electrophotographic apparatus having the dimensions described, the encoder sprocket may have a diameter for example of approximately 3 inches and approximately 50 teeth.

Figure 4:
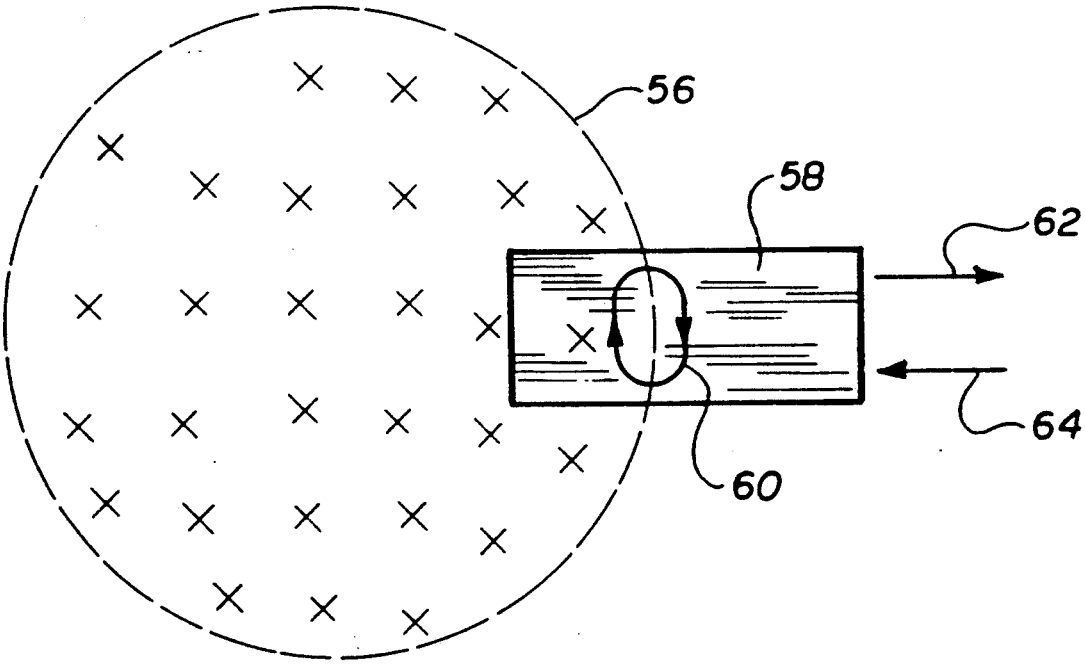
FIG. 4 (PRIOR ART)
FIG. 4 is a schematic representation showing the generation of an eddy current in a plate being moved through a magnetic field.

FIG. 4 is a schematic representation showing the generation of an eddy current in a plate being moved through a magnetic field. As illustrated, a metal plate 58 is shown being drawn through a magnetic field 56 in a direction 62. This results in eddy currents such as that shown at 60 being developed in the plate, and the interaction of the eddy current with the magnetic field produces a reactive force 64 which tends to resist the movement 62. It is this reactive force which produces the braking force component that tends to retard rotation of the encoder sprocket 34, and therefore, to keep the trailing edge of the teeth 50 in contact with the trailing edge 54 of the perforations 38, irrespective of most variations in the velocity of the photoconductor belt 12 in the direction 55.

The braking disc 42 can be fabricated from any electrical conductor; however, the use of copper or aluminum have been found to be particularly desirable.

The optical encoder described can control a variety of operating parameters of electrophotographic copying machines with which the magnetic brake of the invention is employed including such things as printline timing, drive motor speed, velocity and acceleration of the photoconductor film, film position, as well as a number of additional parameters.

While in accordance with the patent statutes, a preferred embodiment and best mode has been presented, the scope of the invention is not limited thereto, but rather is measured by the scope of the attached claims.

We claim:

1. An electrophotographic copying machine comprising:

a photoconductor film belt having a series of perforations;

drive means for driving said film belt;

a writing device for dissipating an electrical charge on said film belt corresponding to a pattern;

an optical encoder operatively connected to said film belt;

rollers in guiding contact with said film belt, and a sprocket brake assembly comprising:

a sprocket spaced from said rollers, but operatively associated with said film belt and having radially extending teeth, the teeth being serially engaged by the perforations of the film belt as the belt moves past said sprocket to rotate said sprocket;

shaft means operatively connected to and rotated by said sprocket;

electrically conductive means rotatable by said shaft means; and electromagnetic means for generating a magnetic force in the path of rotation of said electrically conductive means for generating eddy currents to brake the movement of said electrically conductive means and said sprocket to maintain proper engagement of a rear wall of said perforations with a rear side of said sprocket teeth.

2. The electrophotographic copying machine of claim 1 and further including:

machine logic control means operatively connecting said optical encoder with said drive means to control the operation of said drive means and the movement of said film belt according to the rotation of said sprocket.

3. The machine according to claim 1 wherein said electrically conductive means is a metallic disc that rotates through a magnetic field generated by said electromagnetic means.

4. The machine according to claim 3 wherein said disc is made from copper or aluminum.

5. Braking means for braking rotation of a pivotable device, wherein shaft means are operatively connected to and rotated by said device, said braking means comprising:

magnetic means generating a magnetic force whose magnitude is dependent upon torque operative in said shaft means; and rotation means operatively connected to said shaft means and rotatable in said magnetic force by said shaft means, eddy currents being developed in said rotation means to brake the rotation of said rotation means and the rotation of said pivotable device.

6. Braking means according to claim 5 wherein a film belt with longitudinally disposed perforations rotates said pivotable device, the perforations each having a rear wall opposite the direction in which the film belt is moving, the pivotable device is sprocket means with sprocket teeth and being rotatable with said shaft means, the sprocket teeth having a rear side opposite the direction of rotation of said sprocket means, said magnetic means braking the rotation of said rotation means to keep the engagement of the rear side of said sprocket teeth with the rear wall of the perforations when the film belt is rotating the sprocket means.

7. Braking means according to claim 5 and further including control means operatively connected to said magnetic means for controlling the magnitude of said magnetic force.

8. Braking means according to claim 7 wherein said control means is operatively connected to said shaft means, for controlling the magnitude of said magnetic force in accordance with the rotation of said shaft means.

9. Braking means in accordance with claim 7 wherein said pivotable device is sprocket means having sprocket teeth, said sprocket means being mounted on said shaft means and being rotatable by carrier means having perforations drivingly engageable with said sprocket teeth, and wherein:

said magnetic means comprises electromagnetic means having a controllable magnetic force; and said control means is electrically connected to said electromagnetic means for controlling the magnetic force generated by said electromagnetic means according to the rotation of said shaft means and said sprocket means, to in turn control the operating rotation of said sprocket teeth and the perforations.

* * * * *